US011225750B2

(12) United States Patent
Lang et al.

(10) Patent No.: US 11,225,750 B2
(45) Date of Patent: Jan. 18, 2022

(54) DOOR LATCH FOR A DOMESTIC ELECTRICAL APPLIANCE

(71) Applicant: emz-Hanauer GmbH & Co. KGaA, Nabburg (DE)

(72) Inventors: Markus Lang, Neunburg vorm Wald (DE); Georg Spiessl, Altendorf (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 712 days.

(21) Appl. No.: 15/831,960

(22) Filed: Dec. 5, 2017

(65) Prior Publication Data

US 2018/0153370 A1 Jun. 7, 2018

(30) Foreign Application Priority Data

Dec. 6, 2016 (DE) ..... 10 2016 014 481.5

(51) Int. Cl.

| | |
|---|---|
| ***E05B 47/00*** | (2006.01) |
| ***E05B 47/06*** | (2006.01) |
| ***D06F 37/42*** | (2006.01) |
| ***F24C 15/02*** | (2006.01) |
| ***E05B 47/02*** | (2006.01) |
| ***A47L 15/42*** | (2006.01) |
| ***E05C 3/12*** | (2006.01) |
| ***H01H 9/20*** | (2006.01) |
| *D06F 39/14* | (2006.01) |

(52) U.S. Cl.

CPC ..... *D06F 37/42* (2013.01); *A47L 15/4259* (2013.01); *E05B 47/0004* (2013.01); *E05B 47/0005* (2013.01); *E05B 47/026* (2013.01); *E05B 47/0603* (2013.01); *E05B 47/0607* (2013.01); *E05C 3/12* (2013.01); *F24C 15/022* (2013.01); *H01H 9/20* (2013.01); *A47L 2501/22* (2013.01); *D06F 39/14* (2013.01); *Y10S 292/69* (2013.01); *Y10T 292/1089* (2015.04)

(58) Field of Classification Search

CPC ..... Y10T 292/1021; Y10T 292/1089; Y10T 292/307; Y10T 292/308; Y10S 292/69; E05B 47/0005; E05B 47/0607

See application file for complete search history.

(56) References Cited

U.S. PATENT DOCUMENTS 758,632 A * 5/1904 Emond ..... E05B 85/28 292/279
814,177 A * 3/1906 Warren ..... E05B 85/28 292/279

(Continued)

FOREIGN PATENT DOCUMENTS

CN 101666028 a 3/2010
DE 3911592 A1 * 10/1990 ..... H02K 7/116

(Continued)

OTHER PUBLICATIONS

CN Office Action with English translation in co-pending application CN 201711281301.6, dated Feb. 10, 2020.

(Continued)

*Primary Examiner* — Carlos Lugo
(74) *Attorney, Agent, or Firm* — Hayes Soloway PC

(57) ABSTRACT

A door latch for a domestic electrical appliance is provided, which door latch has an electromotively driven locking element for locking the closed door.

15 Claims, 7 Drawing Sheets

(56) References Cited

U.S. PATENT DOCUMENTS 3,040,555 A * 6/1962 Wartian ..... E05C 3/24 70/97
3,325,203 A * 6/1967 Moler ..... E05C 3/24 292/201
4,315,649 A * 2/1982 Lutz ..... E05B 81/25 292/201
4,494,782 A * 1/1985 Lutz ..... E05B 81/25 292/96
5,193,861 A * 3/1993 Juga ..... E05C 3/34 292/207
5,236,234 A * 8/1993 Norman ..... E05B 81/06 292/201
5,441,317 A * 8/1995 Gruden ..... B60R 25/00 292/144
5,951,070 A * 9/1999 Spurr ..... E05B 81/25 292/201
6,435,573 B1 * 8/2002 Szablewski ..... E05B 81/14 292/201
6,522,095 B2 * 2/2003 Kachouh ..... E05B 81/14 292/169
6,659,018 B1 * 12/2003 Jackson ..... E05B 15/0046 105/355
6,698,805 B2 * 3/2004 Erices ..... E05B 77/04 292/201
6,719,333 B2 * 4/2004 Rice ..... E05B 81/14 292/201
6,936,983 B2 * 8/2005 Kachouh ..... E05B 81/06 292/201
7,455,335 B2 * 11/2008 Garneau ..... E05B 47/0012 292/144
7,500,700 B2 * 3/2009 Kunst ..... E05B 81/14 292/201
7,731,250 B2 * 6/2010 Garneau ..... E05B 47/026 292/144
7,770,944 B2 * 8/2010 Yuan ..... E05B 47/0607 292/195
8,085,530 B2 * 12/2011 Zhang ..... G06F 1/187 361/679.33
8,360,485 B2 * 1/2013 Ma ..... H05K 5/0221 292/333
8,991,877 B2 3/2015 Spiessl
9,528,298 B2 * 12/2016 Osvatic ..... E05B 15/101
10,119,312 B2 * 11/2018 Wang ..... A47L 15/4259
2005/0173932 A1 * 8/2005 Lomicka ..... F24C 15/022 292/201
2016/0138809 A1 * 5/2016 Colucci ..... E05C 19/00 292/122
2016/0251881 A1 * 9/2016 Dirnberger ..... D06F 37/28 292/195

FOREIGN PATENT DOCUMENTS

DE 19837248 A1 2/2000
DE 102004060607 B3 3/2006
DE 102015002538 B3 3/2016
WO 2011132213 A1 10/2011
WO 2013109585 A2 7/2013

OTHER PUBLICATIONS

CN Office Action notice letter dated Mar. 3, 2020 from CN associates in co-pending application CN 201711281301.6.

* cited by examiner

DOOR LATCH FOR A DOMESTIC ELECTRICAL APPLIANCE

BACKGROUND OF THE INVENTION

1. Field of the Invention

The present invention relates generally to a door latch for a domestic electrical appliance, for example a washing machine or an electric oven. In addition, the invention relates to a domestic appliance equipped with such a door latch.

2. Description of the Prior Art

The door latch in question is a door latch with so-called indirect locking. Locking means that, after the door of the domestic appliance has been closed, a locking element is moved by means of an actuator from an unlocking position into a locking position and the door, which is already closed, is thus additionally locked so that it is protected against opening. This is expedient and necessary in particular in domestic appliances where, for safety reasons, it must not be possible to open the door while the domestic appliance is in operation, such as, for example, in the case of washing machines because of the risk of large amounts of hot water escaping and in the case of electric ovens because of the heat.

Indirect locking refers to a concept in which the locking element does not directly block a movably arranged closure component of the door latch that is responsible for holding the door closed, but blocks the movability of another component which for its part is situated in the movement path of the closure member when the door is closed and thus counteracts opening of the door. Typically, this other component must be moved against a spring force if the closed but unlatched door is to be opened. Examples of conventional forms of a door latch with indirect locking are to be found in DE 10 2015 002 538 B3, WO 2011/132213 A1 and WO 2013/109585 A1.

SUMMARY OF THE INVENTION

In some embodiments, a door latch according to the invention for a domestic electrical appliance comprises a latch housing, a gripping unit which is arranged in the latch housing to be rotatable between a gripping position and an opening position and which in the gripping position grips a closing stirrup in order to hold a door of the domestic appliance closed and in the opening position releases the closing stirrup in order to open the door, a blocking element which is arranged to be movable, in particular linearly, between a blocking position and a release position and which assumes its blocking position when the gripping unit is in the gripping position and assumes its release position when the gripping unit is in the opening position, wherein the blocking element in the blocking position counteracts a rotation of the gripping unit in the direction towards the opening position, a locking element which is arranged to be movable, in particular linearly, between an unlocking position and a locking position and which in the unlocking position permits a movement of the blocking element between the blocking position and the release position and in the locking position blocks the blocking element against movement from the blocking position into the release position, and an actuating unit for displacing the locking element between the unlocking position and the locking position.

According to the invention, the actuating unit comprises an electric drive motor which is in drive connection with the locking element.

In other embodiments, a door latch according to the invention for a domestic electrical appliance comprises a latch housing having a hook introduction opening, a blocking element which is guided in a displaceable manner, in particular linearly, in the latch housing and which, as the door is closed, is pushed by the closing lock from a release position, in which it allows a pivotal closing hook to be introduced into the hook introduction opening, into a blocking position, in which it prevents the closing hook from being pulled out of the hook introduction opening, a locking element which is arranged to be movable, in particular linearly, between an unlocking position and a locking position and which in the unlocking position permits a movement of the blocking element between the blocking position and the release position and in the locking position blocks the blocking element against movement from the blocking position into the release position, and an actuating unit for displacing the locking element between the unlocking position and the locking position, wherein the actuating unit comprises an electric drive motor which is in drive connection with the locking element.

The invention takes advantage of the observation that the concept of indirect locking allows a substantial portion of the pulling forces that can act on the closure component (gripping unit, closing hook) when an attempt is made to open the closed and locked door by force to be dispersed by force splitting into the latch housing of the door latch, bypassing the locking element. Various methods of force splitting are disclosed in the three publications mentioned above. If such force splitting is implemented (which is not a necessary requirement within the context of the present disclosure), the locking element only has to be able to absorb a comparatively small portion of the forces that occur. The stability requirements of the locking element can be correspondingly low. These requirements can be met by a comparatively small and lightweight form of the locking element. This in turn lowers the requirements of the force of the actuating unit. While electromagnetic actuators even of comparatively small size are able to apply sufficiently high forces to move even relatively large components in a door latch reliably, it has been shown that the concept of indirect locking opens up the way for the use of an electric drive motor for actuating the locking element, without increasing the required installation space for the door latch. Because of the comparatively low mass of the locking element, a miniature motor may suffice, which then also fits into the generally extremely small available installation space in the door latch. In the case of electromotive actuation of the locking element, it is to be expected that the actuating time of the drive motor for the purposes of transferring the locking element from the unlocking position into the locking position or vice versa will be considerably longer than the duration of typical electrical interference pulses as can repeatedly occur in a domestic appliance supplied with mains voltage. If such interference pulses occur and if they effect brief energisation of the drive motor, this is not sufficient to cause an unintentional change in the position of the locking element.

The drive motor can be an alternating current motor or a direct current motor. In particular, the drive motor is designed for operation in a low voltage range of up to not more than approximately 50 V or 40 V or 30 V.

The drive motor and the locking element can be received in a locking module which can be pre-assembled as a modular unit and which is installed in the latch housing.

In some embodiments, the door latch is so designed that a continued rotation of the drive motor in the same direction of rotation effects alternating displacement of the locking element between the unlocking position and the locking position. In such cases it is not necessary to be able to reverse the direction of rotation of the drive motor.

In some embodiments, a multi-wheel gear train which acts in a speed-reducing manner is provided between the drive motor and the locking element in the force transmission direction.

In some embodiments, formations which convert a rotational movement of the toothed wheel into a linear movement of the locking element are operative between a toothed wheel of the actuating unit and the locking element. These formations can comprise a ramp/ramp follower arrangement having at least one ramp track which extends in the circumferential direction of the toothed wheel and is arranged on one of the two components: toothed wheel and locking element, wherein there is formed on the other of the two components at least one ramp follower which is designed to travel on the ramp track as the toothed wheel rotates. In particular, the ramp/ramp follower arrangement can comprise a plurality of ramp tracks distributed in the circumferential direction of the toothed wheel, wherein the ramp follower travels on the ramp tracks in succession as the toothed wheel continues to rotate.

In some embodiments, the toothed wheel is in the form of an annular disc with a central ring opening. In these embodiments, the locking element projects through the ring opening of the toothed wheel and is arranged to be displaceable linearly between the unlocking position and the locking position perpendicularly to the disc plane of the toothed wheel. The locking element can be configured on a first disc side of the toothed wheel for locking engagement with a movably arranged latch component, in particular the blocking element, and on the other, second disc side for spring-loaded contact by a leaf spring element, which is the carrier for a switch contact of an electric switch which indicates the locked state of the door latch.

The ramp tracks can be formed on the second disc side of the toothed wheel. In this case, the locking element can have a structure which surmounts the ramp tracks and on which there is formed a plurality of lugs which cooperate with the ramp tracks and each of which serves as a ramp follower.

A domestic electrical appliance according to the invention, in particular in the form of a washing machine or electric oven, comprises a door latch of the type described above and also two electrical plug interface units which are joined together to form an electrical plug connection, wherein a first of the plug interface units is assembled with the door latch to form a prefabricated modular unit and the second of the plug interface units is electrically connected to a main circuit of the domestic appliance, wherein the second plug interface unit provides a supply voltage for the drive motor in a safe voltage range of up to not more than 50 volts or not more than 40 volts or not more than 30 volts, for example approximately 24 volts or approximately 12 volts.

The invention will be explained further below with reference to the accompanying drawings

DETAILED DESCRIPTION OF THE INVENTION

Figure 2:
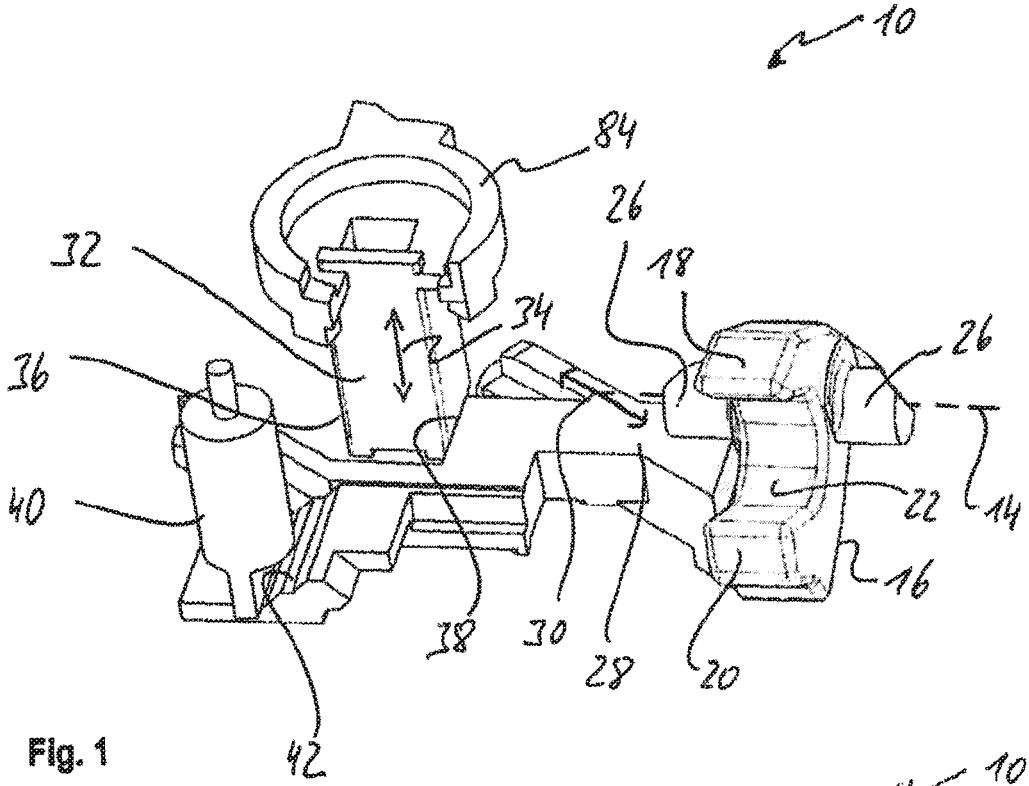
FIG. 2 is a perspective view of individual components of the door latch of FIG. 1.
Figure 1:
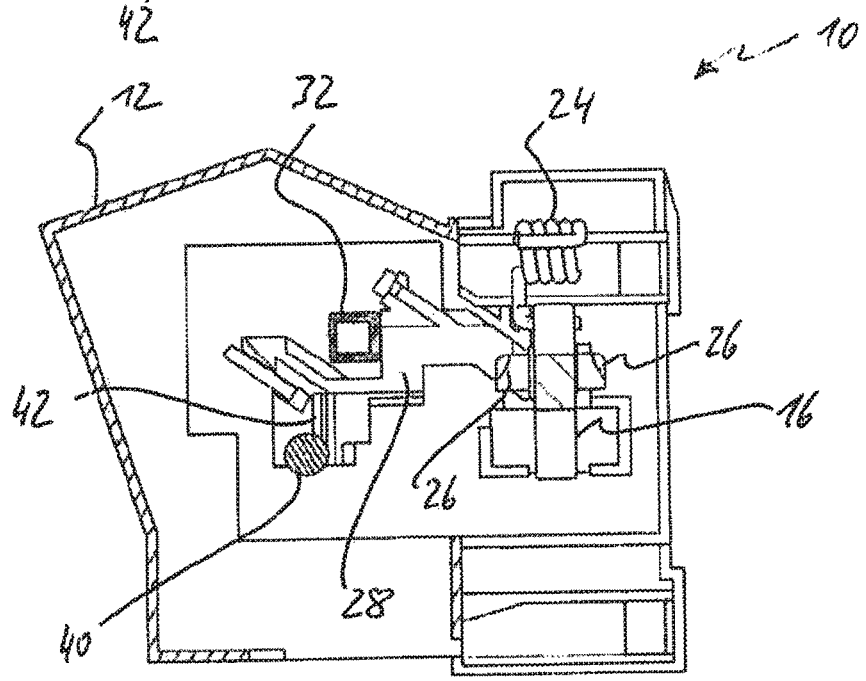
FIG. 1 shows, in diagrammatic form, components of a door latch according to a first embodiment.

Reference will first be made to FIGS. 1 and 2. The door latch shown therein is designated generally 10. It comprises a latch housing 12 in which there is received a gripper 16 having a gripping jaw 22 delimited by two gripping cheeks 18, 20, which gripper is rotatably mounted about an axis of rotation 14. The latch housing 12 is, for example, in at least two parts with a bottom housing part and a cover part which can be joined to the bottom part by a snap fit, for example, the bottom part and the cover part delimiting between them a housing interior in which the gripper 16 is located. The gripper 16 can be mounted on one of the two housing parts, for example the cover part. The latch housing 12 with the components accommodated therein is mounted, for example, in a main appliance body of the domestic appliance in question. A treatment chamber for the items to be treated by means of the domestic appliance (e.g. laundry, food for heating), which treatment chamber can be closed by an appliance door, is formed in the main appliance body. The gripper 16 serves to grip a closing stirrup (not shown) which is mounted on the door of the domestic appliance and, as the door closes, comes into contact with one of the gripping cheeks 18, 20 of the gripper, thereby initiates a rotation of the gripper 16 about the axis of rotation 14 and consequently is engaged from behind by the other of the two gripping cheeks 18, 20, with the result that the closing stirrup is trapped in the gripping jaw 22. During this gripping/rotating movement of the gripper 16, the gripper can additionally undergo a translational displacement which is caused by a sudden relaxation of a closing spring arrangement (not shown) and exerts a door-closing effect on the door. The configuration of such a door-closing mechanism is generally known among experts and does not require further explanation. It will be appreciated that the mentioned closing stirrup can also be arranged on the main appliance body of the domestic appliance instead of on the door; in this case, the latch housing 12 with the components located therein is mounted on the door of the domestic appliance.

The gripper 16 is spring-biased by a torsion spring 24 into an open position, which it assumes when the door is open. The rotational movement from the opening position into a gripping position which the gripper 16 performs as the door closes accordingly takes place against the biasing force of the torsion spring 24. For mounting of the gripper 16, it has two bearing pins 26 which protrude on both sides and are guided, for example, in slot-like guide channels (not shown) which are formed by the latch housing 12 and permit not only the mentioned rotation of the gripper 16 about the axis of rotation 14 but also in addition a translational displacement of the gripper 16.

A main slider 28, which serves as the blocking element within the meaning of the invention and is movable to and fro in a linear sliding direction 30, which in the example shown runs at an angle to the axis of rotation 14, between a blocking position and a release position, cooperates with the gripper 16. A force splitting has the effect that a portion of the force acting via the gripper 16 on the main slider 28 when an attempt is made to open the door by force is dispersed directly to the latch housing 12 and only a residual portion is transmitted into a locking element, which will be described below. For details of this force splitting, reference is made to DE 10 2015 002 538 B3 mentioned at the beginning, the content of which is incorporated herein by explicit reference. The main slider 28 is under the action of a biasing spring, in a manner not shown in detail, which biases the main slider 28 in contact with the gripper 16. When the door is open, that is to say when the gripper 16 is in the opening position, the main slider assumes its release position. In this position, it pushes under the action of the mentioned biasing spring against a lateral cheek of the gripper 16 but does not extend into the rotational movement path of the gripper 16. As the door closes, that is to say when the gripper 16 rotates from its opening position into the gripping position, the main slider 28 slides on account of the biasing force acting thereon into a blocking position, in which it protrudes with a blocking portion (not shown in the figures) into the rotational movement path of the gripper 16. As a result, the main slider 28 prevents the gripper 16 from rotating back out of the gripping position into the opening position when the door is closed. A user can easily overcome this obstruction by applying a sufficiently great pulling force on the door. In this case, the gripper 16 pushes the main slider 28 against the action of the mentioned biasing spring out of the blocking position into the release position. In this manner, as the door is closed and opened in succession, the main slider 28 switches to and fro between its release position and its blocking position.

In the representation of FIGS. 1 and 2, the main slider 28 is in its blocking position. In this situation, the main slider 28 can be locked against moving back into the release position by a locking element 32. In the example shown, the locking element 32 is movable in a linear sliding direction 34 perpendicular to the sliding direction 30 of the main slider 28 into and out of the sliding path of the main slider 28. In the representation of FIG. 2, the locking element 32, which in the embodiment shown has a pin-like locking portion 36 with an approximately square contour, is in a locking position in which it has been moved in front of a locking edge 38 of the main slider 28 and thus blocks the main slider 28 from returning from the blocking position into the release position. Consequently, in the situation shown in FIG. 2, the door of the domestic appliance cannot be opened by applying normal force because the main slider 28 prevents the gripper 16 from rotating back out of the gripping position (corresponding to FIG. 2) into the opening position. Only when the locking element 32 is lifted upwards—in reference to the representation in FIG. 2—so that it moves away from the locking edge 38 and is no longer in the movement path of the main slider 38 is the gripper 16 able to push the main slider 28 back into its release position when an attempt is made to open the door. The mentioned lifted position of the locking element 32 accordingly corresponds to an unlocking position.

There can additionally be seen in FIGS. 1, 2 a lifter 40, in this example in the form of a pin, which is arranged to be displaceable in a direction parallel to the sliding direction 34 of the locking element 32 and can be controlled in terms of its position by a control ramp 42 formed on the main slider 28. The lifter 40 serves to lift a leaf spring element 44 (see FIG. 6), which is the carrier for a switch contact (not shown) of an electric door switch. This electric door switch changes its switch state in dependence on the closing of the door and indicates to a main control unit 45 of the domestic appliance (see FIG. 6) whether the door is open or closed. For further details of the lifter 40 and the control of its position by the main slider 28, reference is made to German patent application no. 10 2015 011 809.9, the content of which is incorporated by explicit reference.

Figure 3:
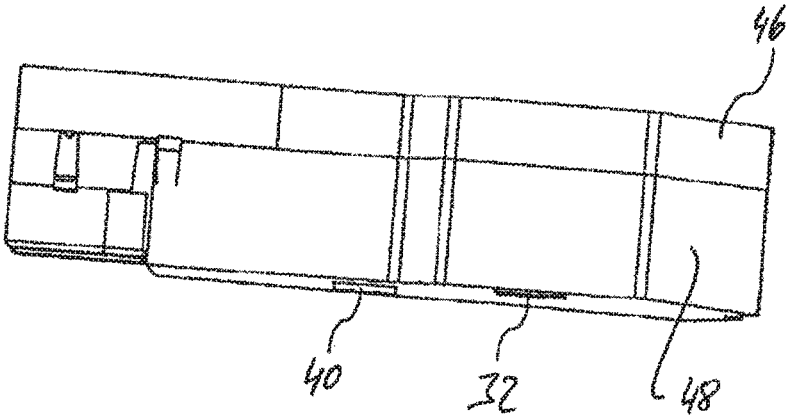
FIGS. 3 to 5 are outside views of a locking module of the door latch of FIG. 1 in three different states.
Figure 4:
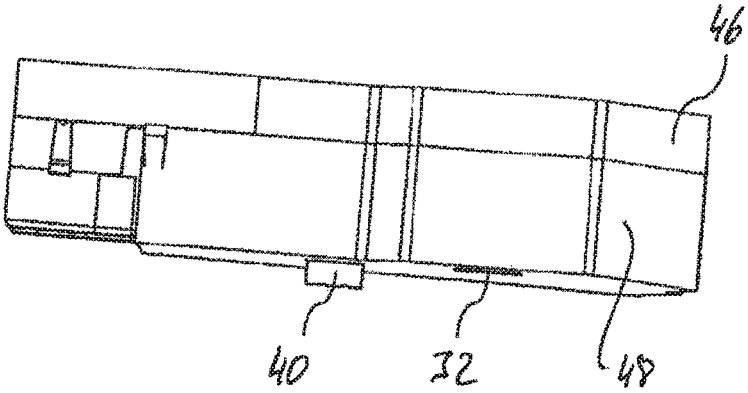
Figure 5:
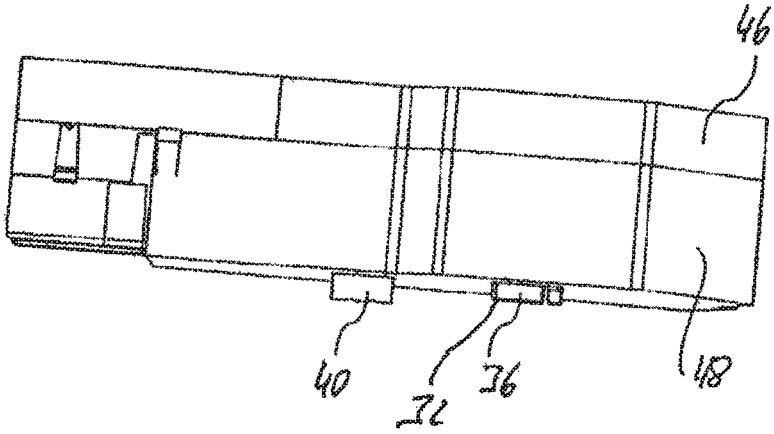

Reference will now additionally be made to FIGS. 3 to 5. These figures show a locking module 46 which is installed as a prefabricated modular unit in the latch housing 12 and has a module housing 48 in which the locking element 32 and an electromotive actuating unit for the locking element 32 are received. Furthermore, the lifter 44 and the components of two electric switches are accommodated in the locking module 46. The two switches include the door switch already mentioned and also a locking switch, the switch state of which indicates to the main control unit 45 the locked or unlocked state of the door latch 10.

FIG. 3 shows the locking module 46 when the door is open. In this state, the locking element 32 is in its unlocking position and the main slider 28 of the door latch 10 is in its release position. In the unlocking position, the locking element 32 does not protrude or protrudes at most only slightly outwards from the module housing 48 of the locking module 46. Likewise, the lifter 40 is held by the main slider 28 (which is not shown in FIGS. 3 to 5 but is situated directly beneath the locking module 46 in the fitted state in the door latch 10) in a lifted position in which the lifter 40 has moved substantially completely into the locking module 46 and does not protrude or protrudes at most only slightly therefrom.

As the door closes, the main slider 28 moves into the blocking position shown in FIG. 2. The control ramp 42 of the main slider 28 thereby moves past beneath the lifter 40, which allows the lifter 40 to drop. This dropping is accompanied by the lifter 40 emerging from the locking module 46, as is illustrated in FIG. 4.

If the door latch is then also locked, the locking element 32 also emerges from the locking module 46 with its locking portion 36. With the portion of the locking portion 36 that protrudes from the locking module 46, the locking element 32 blocks the main slider 28 in its blocking position. FIG. 5 corresponds to this situation.

Figure 6:
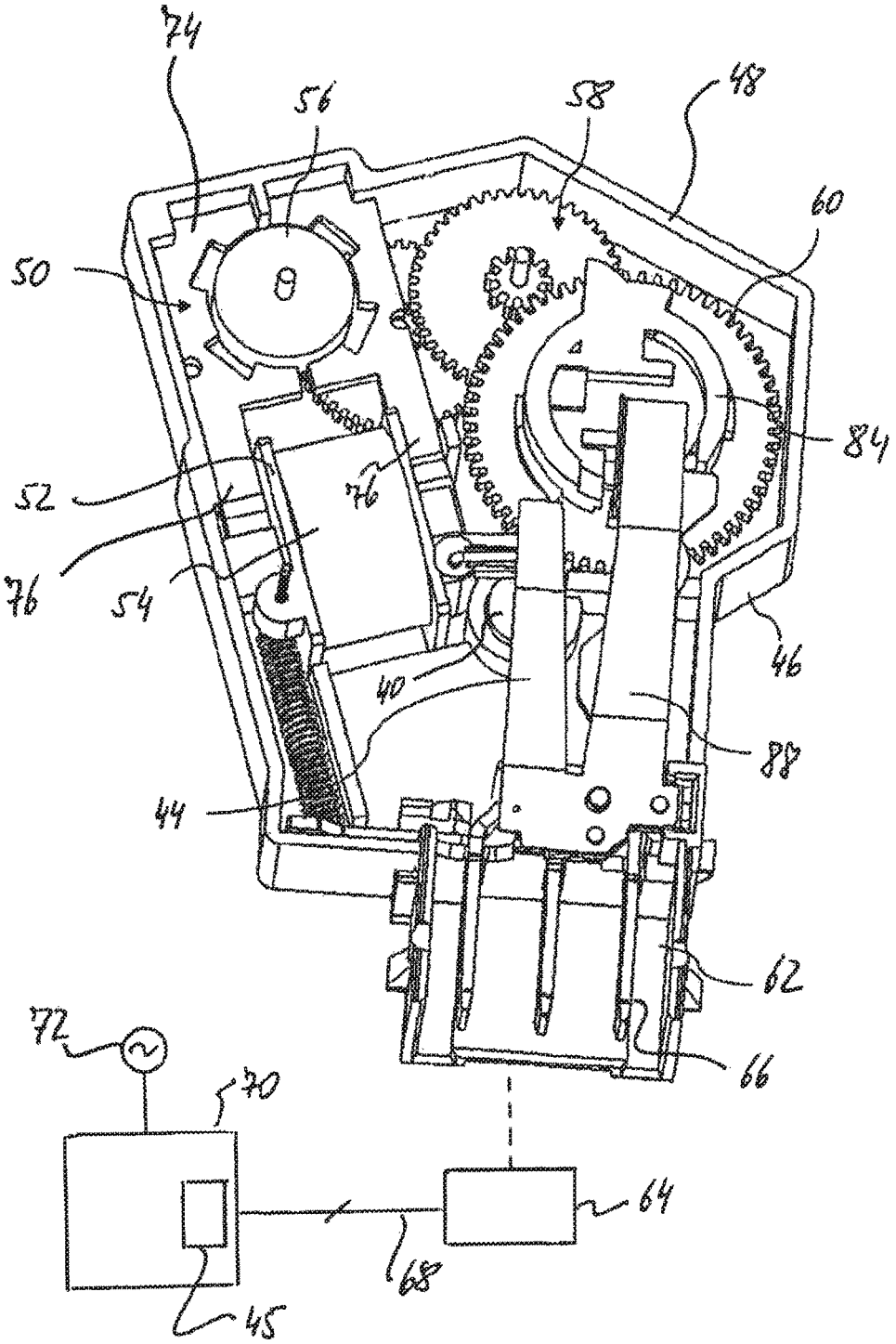
FIG. 6 is a perspective top view of the inner workings of the locking module of FIGS. 3 to 5.
Figure 7:
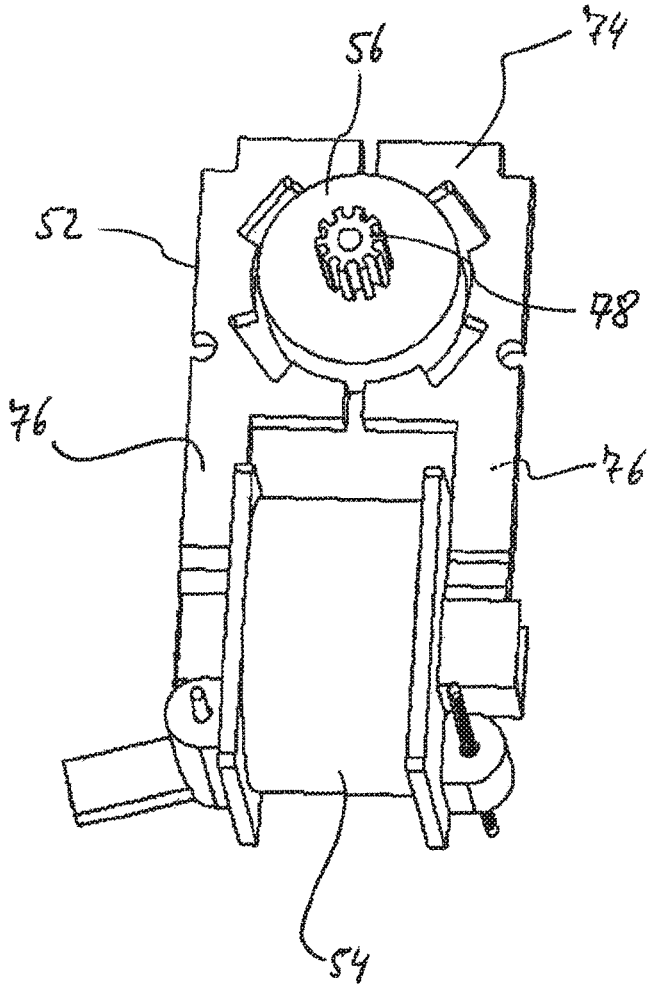
FIG. 7 is a perspective view of an electric motor used in the locking module of FIG. 6 to actuate a locking element.

Reference will now additionally be made to FIGS. 6 and 7. In FIG. 6 there will be seen an actuating unit 50 for the locking element 32, which actuating unit is installed in the module housing 48. The actuating unit 50 is composed of an electric motor 52 having a coil winding 54 and a rotor 56, as well as a multi-wheel gear train 58 which operates as a reduction gear and converts the rotational movement of the rotor 56 into a correspondingly slowed rotational movement of a final—as seen in the force transmission direction—toothed wheel 60 of the gear train 58. The electric motor 52 is a miniature motor and is operated with an operating voltage in a safe low voltage range of, for example, not more than 30 V. For supplying power to the electric motor 52, which may be either an alternating current motor or a direct current motor, the locking module 46 has an electrical plug interface 62 which, for plug connection, is provided with an electrical plug interface 64 which is provided by the manufacturer of the domestic appliance and is fitted to the plug interface 62 of the locking module 46 when the door latch 10 is installed in the domestic appliance. In the example shown, the plug interface 62 forms a plug-in socket having a plurality (here three) of electrical pins 66. The plug interface 64 is correspondingly formed as a plug head having a number of sockets corresponding to the number of electrical pins 66. The plug interface 64 is electrically connected via a group of wires 68, which can be combined in a common cable, to a main circuit 70 of the domestic appliance, which is shown schematically in FIG. 6 by a rectangular box and is supplied with electrical energy from a mains voltage source 72. In the main circuit 70 there are provided suitable converter means for generating from the alternating mains voltage of the mains voltage source 72 (which provides, for example, an alternating mains voltage in the region of approximately 110 V or approximately 230 V) a low voltage of, for example, not more than approximately 30 V, which is supplied via the group of wires 68 to the plug interface 64 so that, after the interfaces 62, 64 have been fitted together, the electric motor 52 can be operated with that low voltage. Depending on the form of the electric motor 52 as an alternating current or direct current motor, the low voltage present at the interface 64 is either an alternating voltage or a direct voltage. Part of the main circuit 70 is the main control unit 45 already mentioned, which is able to query the switch states of the door switch and of the locking switch via the signals on the group of wires 68.

The electric motor 52 can be, for example, in the form of a split-pole motor or in the form of a multiphase motor. The rotor 56 can be, for example, in the form of a permanent magnet rotor. In the example shown, the rotor 56 is seated in a central recess of a rectangular stator plate 74 which has two protruding yoke limbs 76 in the region of one of the rectangle sides, between which the coil winding 54 is arranged.

In FIG. 7 it will additionally be seen that there is arranged on one side of the rotor 56 an input pinion 78 of the gear train 58 which is arranged for joint rotation therewith about the rotor axis. The rotational movement of the input pinion 78 is transmitted to the (output) toothed wheel 60 via a plurality of intermediate toothed wheels. The rotational movement of the (output) toothed wheel is converted into an up and down movement of the locking element 32, the movement direction (designated 34 in FIG. 2) of the locking element 32 being perpendicular to the rotation plane of the toothed wheel 60 (and consequently parallel to the axis of rotation of the toothed wheel 60). For the details of the conversion of the rotational movement of the toothed wheel 60 into a linear up and down movement of the locking element 32, reference will now additionally be made to FIGS. 8 and 9.

The toothed wheel 60 is in the form of an annular disc, the locking element 32 extending through a central ring opening 78 of the toothed wheel 60. On its upper disc side in the representation of FIGS. 8 and 9, the toothed wheel 60 is formed with a plurality of run-up ramps 80 distributed in the circumferential direction (relative to the axis of rotation of the toothed wheel 60), each of which forms a ramp track 82 extending in the circumferential direction of the toothed wheel 60. The run-up ramps 80 are surmounted by an annular or (as in the example shown) semi-annular flange structure 84 of the locking element 32. The flange structure 84 has on its lower side facing the toothed wheel 60 a plurality of lugs 86 which serve as ramp followers and each travel on one of the ramp tracks 82 when the toothed wheel 60 rotates. Advantageously, the number of lugs 86 corresponds to the number of run-up ramps 80. At the upper end of the ramp tracks 82, the run-up ramps 80 each have an upper plateau, after which the run-up ramp 80 in question falls steeply. Owing to this form of the run-up ramps 80, successive switching of the locking element 32 between its unlocking position and its locking position is only possible by always rotating the toothed wheel 60 in the same direction of rotation. If the direction of rotation were reversed, the steeply falling flanks of the run-up ramps 80 would prevent the toothed wheel 60 from rotating beyond a certain point.

Figure 8:
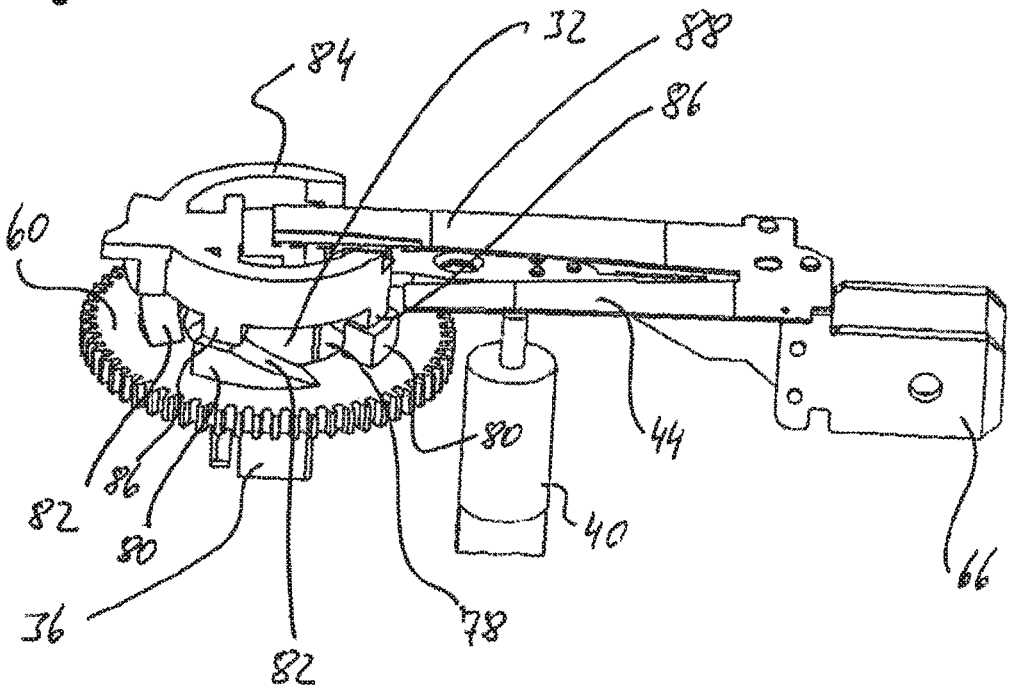
FIGS. 8 and 9 are perspective views of components of the locking module of FIG. 6 in an unlocking state (FIG. 8) and in a locking state (FIG. 9).
Figure 9:
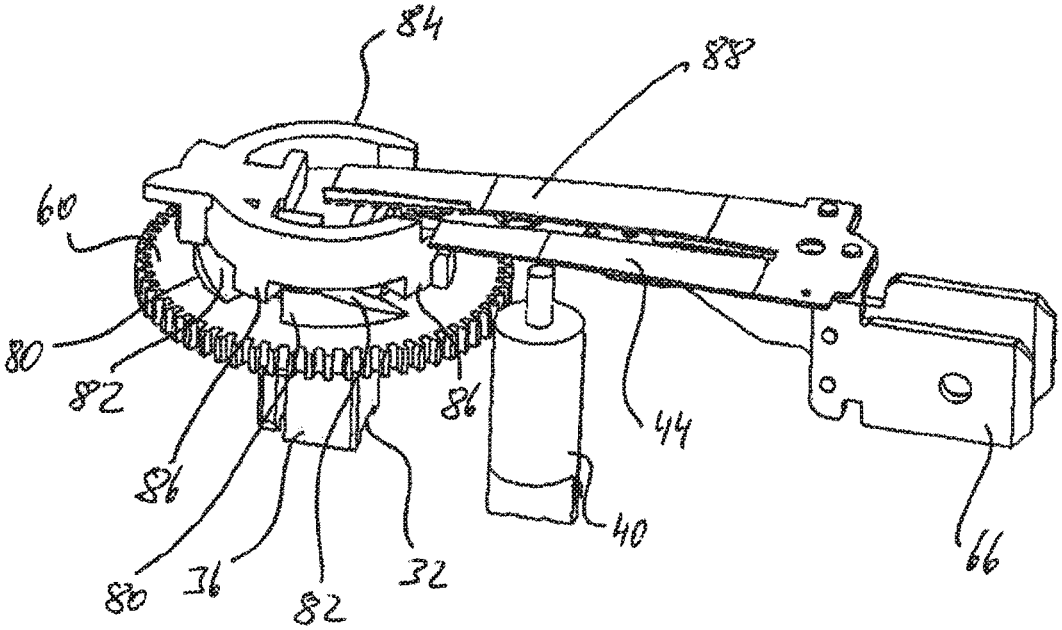

Depending on the angular position of the toothed wheel 60, and accordingly depending on whether the lugs 86 are situated at the foot of the run-up ramps 80 or have travelled up the ramp track 82 onto the upper plateau of the run-up ramps 80, the locking element 32 projects downwards with its locking portion 36 from the lower disc side, in the representation of FIGS. 8 and 9, of the toothed wheel 60 to a greater or lesser extent. The position according to FIG. 8, in which the lugs 86 are situated on the upper plateau of the run-up ramps 80, corresponds to the unlocking position of the locking element 32. In this position, the locking element 32 projects downwards to a lesser extent, so that it does not protrude from the module housing 48 of the locking module 46, according to FIGS. 3 and 4. The situation according to FIG. 9, on the other hand, corresponds to the locking position of the locking element 32. The lugs 86 are here situated between the run-up ramps 80; the locking element 32 accordingly protrudes further downwards from the toothed wheel 60. This corresponds to the state according to FIG. 5, in which the locking element 32 protrudes with its locking portion 36 from the module housing 48 of the locking module 46.

Together with the up and down movement of the locking element 32, a leaf spring element 88 which rests on the flange structure 84 under its own spring tension is moved alternately up and down. The leaf spring element 88 (like the leaf spring element 44) is the carrier for a switch contact (not shown) which forms one of two switch contacts of the mentioned locking switch. According to the position of the locking element 32, that is to say according to whether the locking element 32 is in its lifted position according to FIG. 8 or in its lowered position according to FIG. 9, the locking switch has a different switch state.

Figure 10:
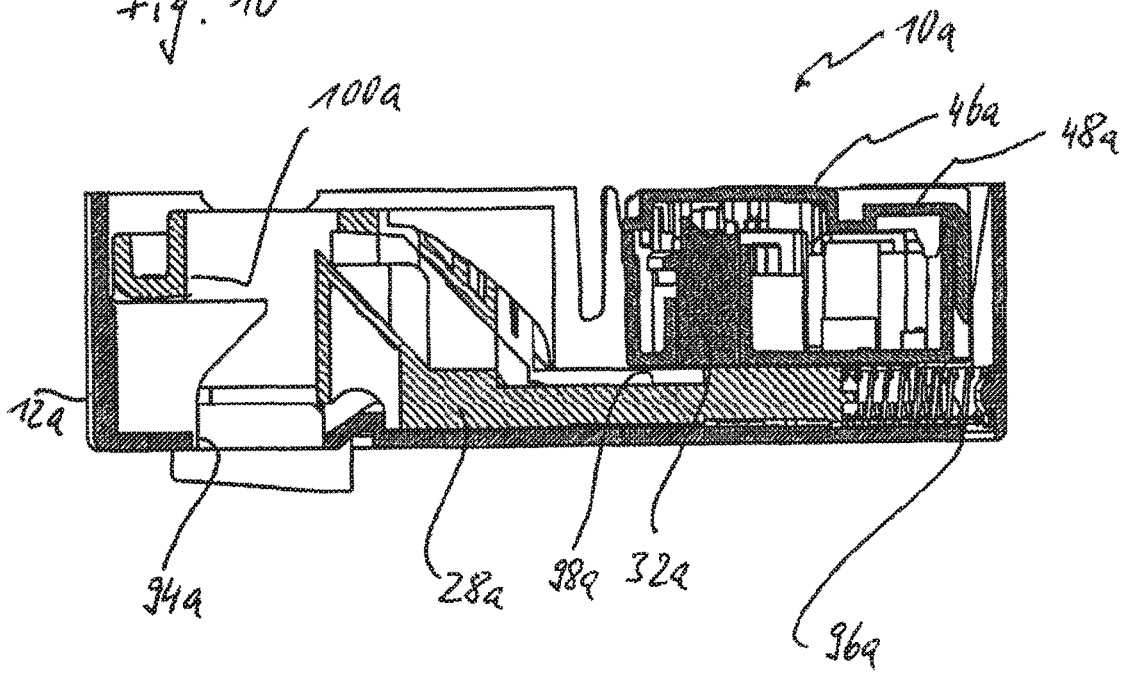
FIGS. 10, 11 and 12 show, in diagrammatic form, components of a door latch according to a second embodiment in a state in which the door is open (FIG. 10), in a state in which the door is closed but still unlocked (FIG. 11) and in a state in which the door is closed and locked (FIG. 12).
Figure 11:
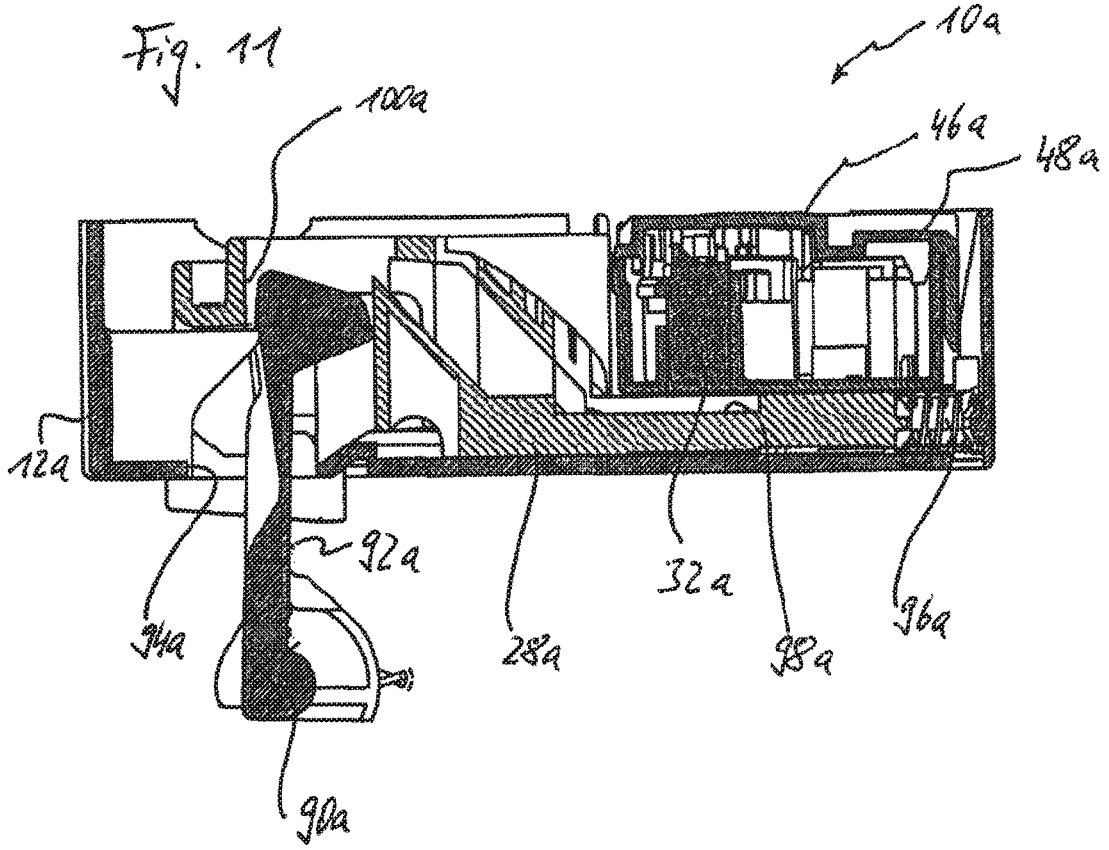
Figure 12:
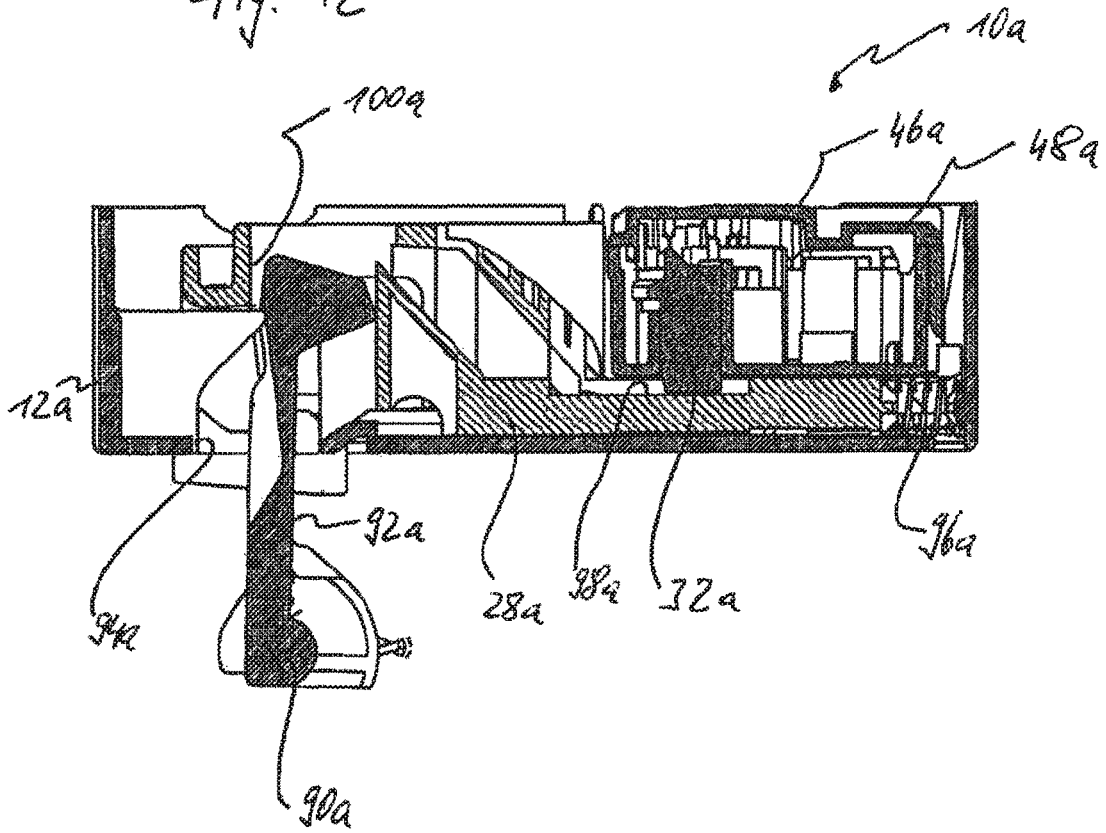

Finally, reference will be made to the second embodiment according to FIGS. 10 to 12. In these figures, components that are the same or have the same effect are provided with the same reference numerals as in FIGS. 1 to 9 but with the addition of a lower case letter. Unless indicated otherwise hereinbelow, reference is made to the preceding observations for the explanation of these components.

In the second embodiment, the gripping unit 16 and the closing stirrup, which is gripped thereby as the door closes, of the first embodiment are replaced by a closing hook **92*a* which is mounted (e.g. on the door) to be pivotable about a pivot axis 90*a* and which, as the door closes, enters the door latch 10*a* through a hook introduction opening 94*a* formed in the latch housing 12*a*. The cooperation of the closing hook 92*a* with the opening edge of the hook introduction opening 94*a* has the effect that, as the door closes, the closing hook 92*a* is first pivoted against the action of a biasing spring (not shown), so that the closing hook 92*a* is able to pass through the hook introduction opening 94*a*. As soon as the closing hook 92*a* has passed through the hook introduction opening 94*a*, it pivots under the action of its biasing spring in the direction back towards its rest position according to FIGS. 11 and 12. It thereby pushes a blocking slider 28***a*, which is movably guided in the latch housing 12*a* in a linear sliding direction, from a first slider position (FIG. 10) into a second slider position (FIGS. 11, 12). The blocking slider 28*a* corresponds functionally to the main slider 28 of the first embodiment and is spring biased in the direction towards its first slider position by a biasing element 96*a*, which in the example shown is in the form of a helical compression spring. In the second slider position, the blocking slider 28*a* has been displaced so far in its sliding direction that the locking element 32*a* is able to enter a locking recess 98*a* of the blocking slider 28*a*. By the engagement of the locking element 32*a* in the locking recess 98*a*, the blocking slider 28*a* can be blocked in its second slider position. Opening of the door is not possible in this state. As the door closes, the closing hook 92*a* enters a through-hole 100*a* of the blocking slider 28*a* and, when the door is locked, is prevented from pivoting counter-clockwise (in the representation of FIG. 12) by the delimiting wall of the through-hole 100*a*.

As in the first embodiment, the locking element 32*a* in the second embodiment is part of a locking module 46*a* which can be pre-assembled as a modular unit and in which an electromotive actuating unit (not shown in FIGS. 10 to 12) for the locking element 32*a* is accommodated. For details of the form of this actuating unit, reference is made to the corresponding explanations relating to the locking module 46 and the actuating unit 60 of the first embodiment accommodated therein.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for a domestic electrical appliance comprising:

a latch housing;

a gripping unit which is arranged in the latch housing to be rotatable between a gripping position and an opening position and which in the gripping position grips a closing stirrup in order to hold a door of the domestic appliance closed and in the opening position releases the closing stirrup in order to open the door;

a blocking element which is arranged to be movable between a blocking position and a release position and which assumes its blocking position when the gripping unit is in the gripping position and assumes its release position when the gripping unit is in the opening position, wherein the blocking element slides along a sliding plane that is at an acute angle to an axis of rotation of the gripping unit, wherein the blocking element in the blocking position counteracts a rotation of the gripping unit in the direction towards the opening position;

a locking element which is arranged to be movable between an unlocking position and a locking position and which in the unlocking position permits a movement of the blocking element between the blocking position and the release position and in the locking position blocks the blocking element against movement from the blocking position into the release position; and an actuating unit for displacing the locking element between the unlocking position and the locking position, wherein the actuating unit comprises an electric drive motor which is in drive connection with the locking element via a multi-wheel gear train operating as a reduction gear.

2. The door latch according to claim 1, wherein the multi-wheel gear train includes an input pinion, an output toothed wheel and a plurality of intermediate toothed wheels for transmitting a rotational movement of the input pinion to the output toothed wheel.

3. The door latch according to claim 1, wherein the electric drive motor includes a stator plate, a coil and a rotor, the stator plate having a central recess and two protruding yoke limbs, the rotor being arranged in the recess and the coil being arranged between the yoke limbs, wherein the stator plate, the coil, the rotor, and the multi-wheel gear train are received in a module housing of a locking module which can be pre-assembled as a modular unit and which is installed in the latch housing.

4. The door latch according to claim 1, wherein the drive motor is designed for operation with a supply voltage selected from the group consisting of not more than 50 V, not more than 40 V and not more than 30 V.

5. The door latch according to claim 1, wherein the drive motor is designed for operation with a supply voltage selected from the group consisting of 12 V and 24 V.

6. A door latch for a domestic electrical appliance comprising:

a latch housing;

a gripping unit which is arranged in the latch housing to be rotatable between a gripping position and an opening position and which in the gripping position grips a closing stirrup in order to hold a door of the domestic appliance closed and in the opening position releases the closing stirrup in order to open the door;

a blocking element which is arranged to be movable between a blocking position and a release position and which assumes its blocking position when the gripping unit is in the gripping position and assumes its release position when the gripping unit is in the opening position, wherein the blocking element in the blocking position counteracts a rotation of the gripping unit in the direction towards the opening position;

a locking element which is arranged to be movable between an unlocking position and a locking position and which in the unlocking position permits a movement of the blocking element between the blocking position and the release position and in the locking position blocks the blocking element against movement from the blocking position into the release position; and an actuating unit for displacing the locking element between the unlocking position and the locking position, wherein the actuating unit comprises an electric drive motor which is in drive connection with the locking element, wherein the drive motor and the locking element are received in a locking module which can be pre-assembled as a modular unit and which is installed in the latch housing, the locking module comprising a module housing, wherein the locking element is received in the module housing, wherein the locking element in the locking position protrudes outwards from the module housing to block the blocking element against movement and in the unlocking position does not protrude from the module housing or protrudes from the module housing to a lesser extent than in the locking position to permit movement of the blocking element.

7. The door latch according to claim 6, wherein the locking module comprises a plug-in socket for plug connection with a plug head of an electrical cable, the plug-in socket including a plurality of pins each for carrying an electrical signal.

8. The door latch according to claim 6, wherein the locking module accommodates a first electric switch and a second electric switch, the first electric switch configured to change its switch state in dependence on the closing of the door, the second electric switch configured to change its switch state in dependence on the position of the locking element.

9. A door latch for a domestic electrical appliance comprising:

a latch housing;

a gripping unit which is arranged in the latch housing to be rotatable between a gripping position and an opening position and which in the gripping position grips a closing stirrup in order to hold a door of the domestic appliance closed and in the opening position releases the closing stirrup in order to open the door;

a blocking element which is arranged to be movable between a blocking position and a release position and which assumes its blocking position when the gripping unit is in the gripping position and assumes its release position when the gripping unit is in the opening position, wherein the blocking element in the blocking position counteracts a rotation of the gripping unit in the direction towards the opening position;

a locking element which is arranged to be movable between an unlocking position and a locking position and which in the unlocking position permits a movement of the blocking element between the blocking position and the release position and in the locking position blocks the blocking element against movement from the blocking position into the release position; and an actuating unit for displacing the locking element between the unlocking position and the locking position, wherein the actuating unit comprises an electric drive motor which is in drive connection with the locking element, wherein a continued rotation of the drive motor in the same direction of rotation effects a displacement of the locking element from the unlocking position to the locking position and back to the unlocking position;

wherein the displacement of the locking element is effected by a plurality of run-up ramps distributed in a circumferential direction relative to the axis of rotation of a toothed wheel and a plurality of lugs which serve as ramp followers that travels on one of the plurality of run-up ramps when the toothed wheel rotates.

10. A door latch for a domestic electrical appliance comprising:

a latch housing;

a gripping unit which is arranged in the latch housing to be rotatable between a gripping position and an opening position and which in the gripping position grips a closing stirrup in order to hold a door of the domestic appliance closed and in the opening position releases the closing stirrup in order to open the door;

a blocking element which is arranged to be movable, in particular linearly, between a blocking position and a release position and which assumes its blocking position when the gripping unit is in the gripping position and assumes its release position when the gripping unit is in the opening position, wherein the blocking element in the blocking position counteracts a rotation of the gripping unit in the direction towards the opening position;

a locking element which is arranged to be movable, in particular linearly, between an unlocking position and a locking position and which in the unlocking position permits a movement of the blocking element between the blocking position and the release position and in the locking position blocks the blocking element against movement from the blocking position into the release position; and an actuating unit for displacing the locking element between the unlocking position and the locking position, wherein the actuating unit comprises an electric drive motor which is in drive connection with the locking element, wherein the actuating unit includes a wheel rotatingly driven by the electric motor, and wherein the wheel and the locking element together implement a ramp/ramp follower arrangement having a ramp track and a ramp follower designed to travel on the ramp track as the wheel rotates, wherein the ramp track is formed on one of the wheel and the locking element and the ramp follower is formed on the other of the wheel and the locking element, the ramp/ramp follower arrangement effective to convert a rotational movement of the wheel into a linear movement of the locking element.

11. The door latch according to claim 10, wherein the wheel is a final wheel of a multi-wheel gear train disposed in a force transmission direction between the drive motor and the locking element.

12. The door latch according to claim 10, wherein the ramp/ramp follower arrangement comprises a plurality of ramp tracks distributed in the circumferential direction of the wheel, wherein the ramp follower travels on the ramp tracks in succession as the wheel continues to rotate.

13. The door latch according to claim 10, wherein the wheel is in the form of an annular disc with a central opening and the locking element projects through the central opening of the wheel and is arranged to be displaceable linearly between the unlocking position and the locking position perpendicularly to a disc plane of the wheel.

14. The door latch according to claim 13, wherein the locking element is configured on a first disc side of the wheel for locking engagement with the blocking element, and on a second disc side for spring-loaded contact by a leaf spring element carrying a switch contact of an electric switch which indicates the locked state of the door latch.

15. The door latch according to claim 14, wherein a plurality of ramp tracks are formed on the second disc side of the wheel in a manner distributed in a circumferential direction of the wheel and the locking element has a structure which surmounts the ramp tracks and on which there is formed a plurality of lugs which cooperate with the ramp tracks and each of which serves as a ramp follower.

* * * * *